US011572252B2

(12) United States Patent
Matheeuwsen

(10) Patent No.: US 11,572,252 B2
(45) Date of Patent: Feb. 7, 2023

(54) FALL PROTECTION FOR A LIFT, AS WELL AS A LIFT WITH FALL PROTECTION

(71) Applicant: Raxtar B.V., Veldhoven (NL)

(72) Inventor: Pascal Matheeuwsen, Veldhoven (NL)

( * ) Notice: Subject to any disclaimer, the term of this patent is extended or adjusted under 35 U.S.C. 154(b) by 255 days.

(21) Appl. No.: 16/642,942

(22) PCT Filed: Aug. 30, 2018

(86) PCT No.: PCT/NL2018/050561

§ 371 (c)(1),
(2) Date: Feb. 28, 2020

(87) PCT Pub. No.: WO2019/045564

PCT Pub. Date: Mar. 7, 2019

(65) Prior Publication Data

US 2020/0346894 A1 Nov. 5, 2020

(30) Foreign Application Priority Data

Aug. 30, 2017 (NL) ..... NL2019467

(51) Int. Cl.
*B66B 5/18* (2006.01)
*B66B 5/04* (2006.01)

(52) U.S. Cl.
CPC ..... *B66B 5/18* (2013.01); *B66B 5/044* (2013.01)

(58) Field of Classification Search
CPC .. B66B 5/18; B66B 5/044; B66B 5/20; B66B 5/046
See application file for complete search history.

(56) References Cited

U.S. PATENT DOCUMENTS 3,415,343 A 12/1968 Svensson
4,095,681 A * 6/1978 David ..... F16D 55/36 187/373
4,139,178 A 2/1979 Hippach
4,258,832 A * 3/1981 Thorp ..... B66D 5/14 188/184
4,282,953 A * 8/1981 Lichti ..... B66D 5/14 188/189

(Continued)

FOREIGN PATENT DOCUMENTS

JP H082848 1/1996
WO WO2006115386 11/2006

OTHER PUBLICATIONS

Written Opinion of the International Search Authority for International Patent Application No. PCT/NL2018/050561.

*Primary Examiner* — Michael R Mansen
*Assistant Examiner* — Michelle M Lantrip
(74) *Attorney, Agent, or Firm* — Robinson IP Law, PLLC

(57) ABSTRACT

A lift has a guide, a lift cage which is movable along the guide, lift means for moving the lift cage along the guide, and a fall protection attached to the lift cage provided with coupling pawl (27) which triggers the fall protection device in the event of a downward movement speed of the lift cage, exceeds maximum value. The fall protection has two catches (37*a*), each of which is provided with a comb (45). These combs are coupled to one another such that when one of the catches comes into action the comb of this catch is activated and thereby activates the comb of the other catch which is the coupling pin (27) of this other capture and will bring this other catch into effect.

6 Claims, 5 Drawing Sheets

(56) References Cited

U.S. PATENT DOCUMENTS

| | | | | |
|---|---|---|---|---|
| 4,856,623 | A * | 8/1989 | Romig, Jr. | F16D 59/00 188/180 |
| 6,830,132 | B1 * | 12/2004 | Kang | B66B 5/18 187/373 |
| 8,646,580 | B2 * | 2/2014 | Rossignol | B66B 9/022 187/352 |
| 8,714,312 | B2 * | 5/2014 | Tiner | B66B 5/044 187/293 |
| 9,856,111 | B1 * | 1/2018 | Anderson | B66B 11/0407 |
| 2007/0084672 | A1 * | 4/2007 | Helmle | B66B 7/02 187/270 |

* cited by examiner

FALL PROTECTION FOR A LIFT, AS WELL AS A LIFT WITH FALL PROTECTION

TECHNICAL FILED OF THE INVENTION

The invention relates to a fall protection for an elevator, which elevator comprises a vertical guide, a racking rack extending in the vertical direction, an elevator cage displaceable along the guide, and lifting means for moving the elevator cage along the guide, which fall protection means a catch. which, during use, is attached to the elevator cage and which is activated when a downward speed of movement of the elevator cage exceeds a set maximum value, which capture:

- comprises a housing which is attached to the elevator cage, as well as
- a gear that, during use, is engaged with the rack and is mounted on a gear shaft,
- a brake drum which is rotatably present in the housing and is in contact with an inside of the housing during braking with a braking surface present on an outside, which brake drum is provided with a coupling cam on the inside, and
- a coupling pawl rotatable at one end about a pivot axis which is parallel to and remote from the gear shaft and connected to the gear shaft, and rotates at a high rotational speed of the gear shaft by the centrifugal force of a collapsed position, in which the coupling pawl engages the gear shaft, to an folded-out position where the coupling pawl is moved outwards with the other end and presses against the coupling cam and thereby couples the gear shaft with the brake drum.

The maximum value of the downward movement speed of the elevator cage is set to a value that is not achieved under (normal) operating conditions. Exceeding this maximum value therefore indicates an undesirable situation in which security measures must be taken. The fall arrest device brakes the elevator cage after it has dropped at too high a speed (which indicates the fall of the elevator cage) and brings it to a standstill.

BACKGROUND OF THE INVENTION

Such a fall protection is generally known. The known fall protection has a housing which is fixed to the elevator cage during use and furthermore has a brake drum which is rotatably mounted in the housing and which, during braking, is frictionally in contact with an inside of the housing. An axle is rotatably mounted independently of the brake drum in the brake drum. This shaft protrudes with an end outside the housing. At this end a gear wheel is mounted which, during use, is in engagement with a rack mounted on the guide of the elevator. When moving the elevator cage along the guide, this gear is rotated together with the shaft. On the part of the shaft which is present inside the brake drum, there is a coupling pawl connected to the shaft and forming part of the switch-on means. At high rotational speed of the shaft, the clutch pawl is pivoted by a centrifugal force, the clutch pawl engaging behind a coupling cam on the inside of the brake drum and thereby coupling the brake drum with the shaft. This causes the brake drum to rotate along with the axle and the elevator cage is braked by the frictional contact between the brake drum and the housing. Furthermore, an axle stub is attached to the brake drum which is provided with screw thread. On this shaft stub a nut is present which is fixed in the direction of rotation relative to the housing and there are disc springs between the nut and the housing. As soon as the brake drum starts to rotate, the nut will be moved in the axial direction along the thread and thereby pull the brake drum more tightly against the housing so that the braking force increases until the elevator cage comes to a standstill. If the elevator cage with the load present therein is too heavy for the fall protection, the nut will break the screw thread or break the housing or brake drum, causing the fall protection device to stop working.

SUMMARY OF THE INVENTION

It is an object of the invention to adapt the known fall protection such that it can be coupled with a further identical or similar fall protection such that if one of the fall protection devices comes into operation it also activates the other fall protection, so that a heavier elevator cage including load comes to a halt. can be braked than with the known fall protection. To this end, the fall arrest device according to the invention is characterized in that it comprises, in addition to the said catch, a further catch which is identical or similar to the said catch, and that the fall protection comprises coupling means which connect the two catches with each other such that they are displaced when the coupling catch from one of the catches to the folded-out position, the coupling catch of the other catch to the folded-out position, which coupling means are located in the axial direction next to the brake drum in the housing. As a result, existing catches can easily be linked to each other and it is not necessary to produce completely new catches. The housing can be extended in the axial direction by an annular housing part, the coupling means then being located inside this annular housing part.

Instead of scaling the catch, several catches are used, preferably two. In order to prevent that one of the catches becomes active earlier than the other and decelerates the elevator cage in such a way that the other catch is no longer activated, the catches are coupled in such a way that the activated catch activates the other catch(es).

Preferably, a carrier cam is provided on the coupling catch and each catch comprises a comb which is present in the housing and is rotatable about a further pivot axis which is also parallel to the gear shaft and is connected to the housing and is rotatable between an active position in which the cam is present in the path of travel of the take-away cam and the take-away cam is guided outwards, whereby the coupling catch is moved to the folded-out position, and an inactive position, in which the comb is provided from the path of the take-away cam, and the coupling means are such that When moving the coupling catch from one of the catches to the folded-out position, move the comb from the other catch to the active position so that this comb moves the coupling catch from the other catch to the folded-out position.

The coupling means preferably comprise two coupling cables which are each attached to one of the combs with one end and are connected to a release catch with the other end. By coupling the catches via cables to each other, the distance between the catching and the position of the catches relative to each other is not limited, so that when the fall protection device according to the invention is applied a great constructive freedom is offered in the placement of the catches.

An embodiment of the fall arrest device according to the invention is characterized in that each catch comprises a release catch connected to the housing, which release catch blocks the comb which is connected to a spring and which release catch, when the brake drum is rotated, is rotated by a release cam present on the brake drum, thereby releasing the comb which is then displaced by the spring, one of the coupling cables having one end is connected to the comb of the catch and the other end is connected to the release catch of the other catch and that on rotation of the comb of this catch the release catch of the other catch is displaced whereby also the comb of this other catch is rotated into the rotational path of a take-up cam present on the coupling catch which rotates during rotation of the shaft comes into contact with the comb and is moved together with the coupling catch to a position in which the coupling catch behind the coupling cam on the brake drum. The comb of each catch is thus connected to the release catch of the other catch via a coupling cable.

Another embodiment of the fall arrest device according to the invention is characterized in that each catch:

- a main gear connected to the brake drum, which rotates with the brake drum when the brake drum rotates,
- a coupling gear connected to the housing which is in engagement with the main gear and is connected via a slip coupling to a cable pulley to which one of the coupling cables is fixed, which coupling cable is connected to the other end at the other end near the free end of this comb.

If one of the catches is activated because the coupling catch catches behind the carrier cam and takes the brake drum with it, the main gear wheel will rotate with the brake drum and thereby also rotate the coupling gear with the cable pulley connected thereto. The cable pulley will wind up the attached coupling cable, pulling the clutch cable. This coupling cable will move the comb from the other catch to the active position in the path of travel of the take-away cam on the coupling catch. This take-away cam comes into contact with the comb during rotation of the gear shaft and is thereby moved in the radial direction together with the coupling catch, the coupling catch engaging behind the coupling cam on the brake drum of the other catch so that this brake drum is coupled to the sprocket shaft and this gear shaft and thus the elevator cage will slow down.

The invention also relates to an elevator comprising a guide, an elevator cage displaceable along the guide, lifting means for moving the elevator cage along the guide, and a fall protection device according to the invention attached to the elevator car. In case the elevator is designed as a rack and pinion elevator, the guide is usually attached to an elevator mast.

BRIEF DESCRIPTION OF THE DRAWINGS

The invention will be further elucidated below on the basis of drawings. These drawings show an embodiment of the fall protection according to the present invention. In the drawings.

DETAILED DESCRIPTION

Figure 1:
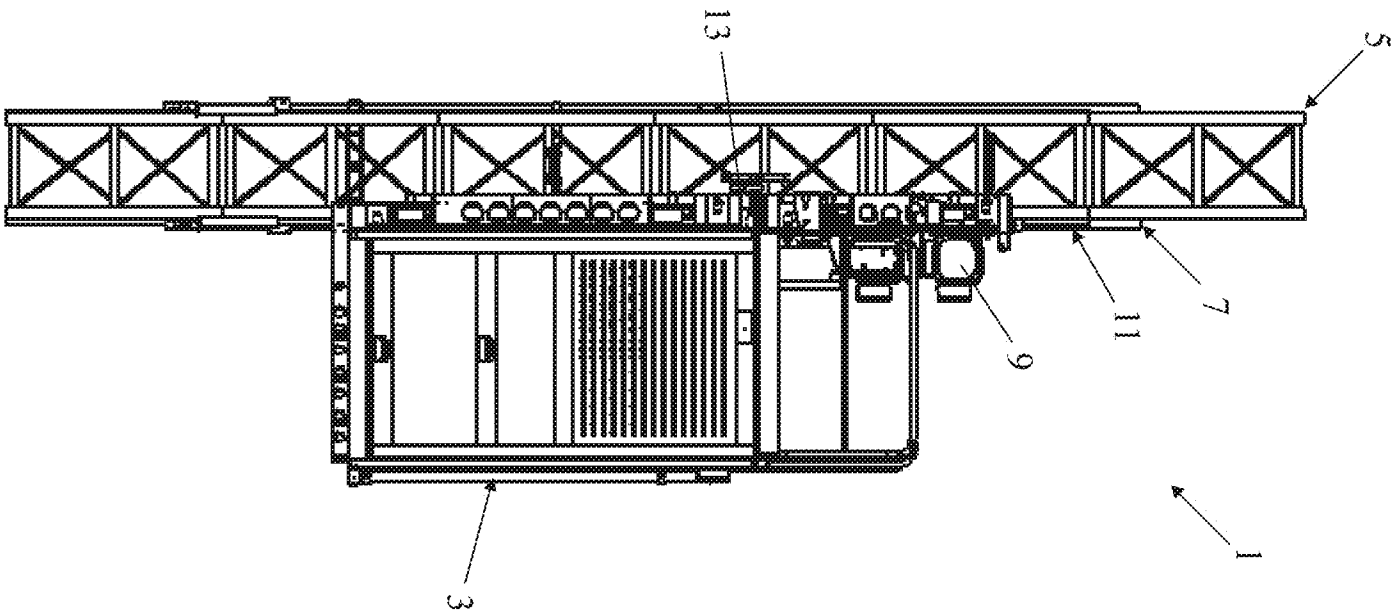
PRIOR ART FIG. 1
FIG. 1 shows a known elevator in the embodiment of a toothed rack elevator.

FIG. 1 shows a known levator as a toothed rack elevator. The elevator 1 has an elevator cage 3 which is movable along a vertical guide 7 attached to an elevator mast 5. The elevator further has elevator means for moving the elevator cage along the guide. These lifting means are formed by an electric motor 9 which is connected via a transmission to a gear wheel which is in engagement with a gear rack 11 fastened to the guide.

The elevator is provided with a fall protection device comprising a catch 13 attached to the elevator cage. If the elevator cage falls down along the guide, the downward speed of movement of the elevator cage exceeding a set maximum value, for instance because the lift means are defective, the switch-on means present in the catch will trigger the catch. The catch will slow down the elevator cage until it comes to a standstill.

Figure 2:
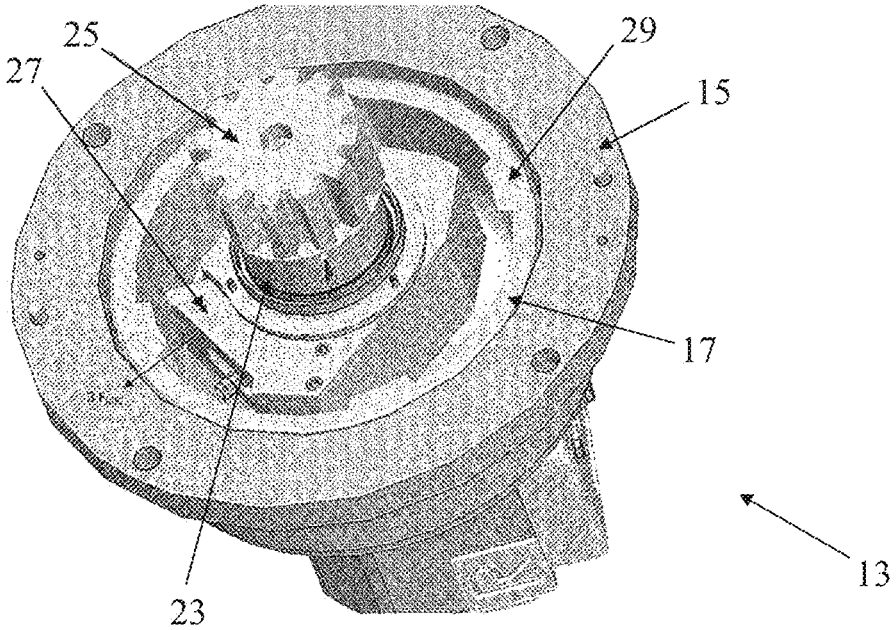
PRIOR ART FIG. 2
FIG. 2 shows the catch of the known elevator shown in FIG. 1 with the housing open.
Figure 3:
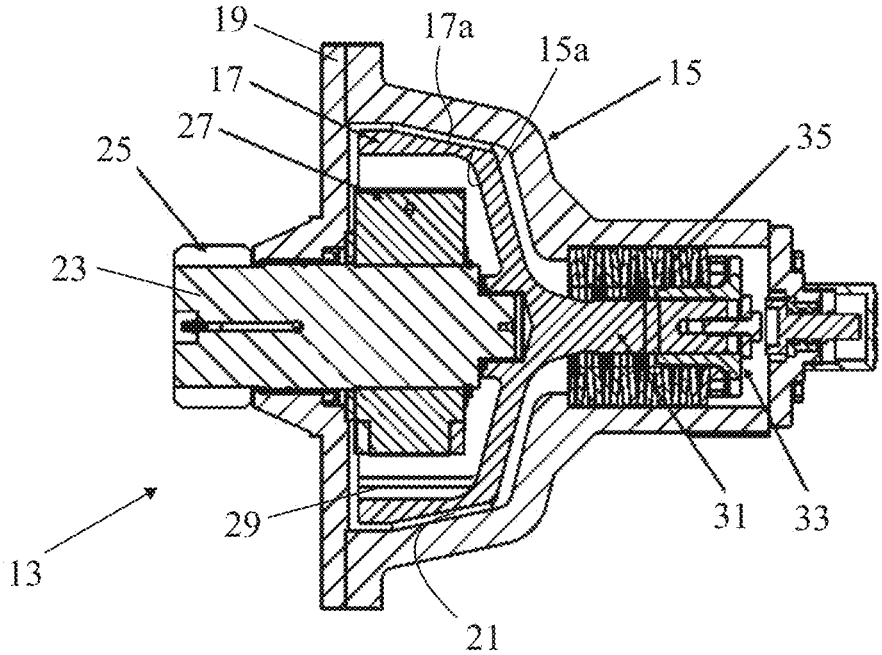
PRIOR ART FIG. 3
FIG. 3 shows the catch shown in FIG. 2 in longitudinal section.

FIGS. 2 and 3 show the catch of the fall protection of the known elevator in perspective (with opened housing) or in longitudinal section, respectively. The catch 13 has a housing 15 which is attached to the elevator cage and a brake drum 17 which is rotatably mounted in the housing. The housing is closed by a cover 19 (see FIG. 3). The brake drum is in contact with an inner side 15*a* of the housing during braking with an outer side 17*a*. The inside of the housing and the outside of the brake drum are slightly conical and one of these sides is provided with a brake lining 21. In the brake drum 17, a shaft 23 is rotatably present independently of the brake drum. This shaft protrudes with an end outside the housing. At this end a gear wheel 25 is mounted which is in engagement with the gear rack present on the guide of the elevator. When moving the elevator cage along the guide, this gear is rotated together with the shaft.

On the part of the shaft present inside the brake drum there is provided a coupling pawl 27 pivotably connected to the shaft and forming part of the switch-on means. At high rotational speed of the shaft, the clutch pawl is pivoted by a centrifugal force, the clutch pawl engaging behind one of the coupling cams 29 present on the inside of the brake drum and thereby coupling the brake drum 17 with the shaft 23. This causes the brake drum to rotate along with the shaft and the gear 25 and thus the elevator cage is braked by the frictional contact between the brake drum and the housing. Furthermore, the brake drum 17 is provided with an axle stub 31, see FIG. 3, which is provided with screw thread. On this shaft stub a nut 33 is present which is fixed in the direction of rotation relative to the housing. Tongue springs 35 are present between the nut 33 and the housing 15. As soon as the brake drum 17 starts to rotate, the nut 33 will move in the axial direction relative to the screw thread and thereby pull the brake drum more firmly against the housing 15 so that the braking force increases until the gear (the elevator car) comes to a standstill.

In the fall protection device according to the invention, (at least) two catches 37*a* and 37*b* (FIG. 5 and FIG. 6 respectively) are attached to the elevator cage. These catches are identical and are linked to each other in such a way that if one of the catches comes into operation it will activate the other catch(es).

Figure 4:
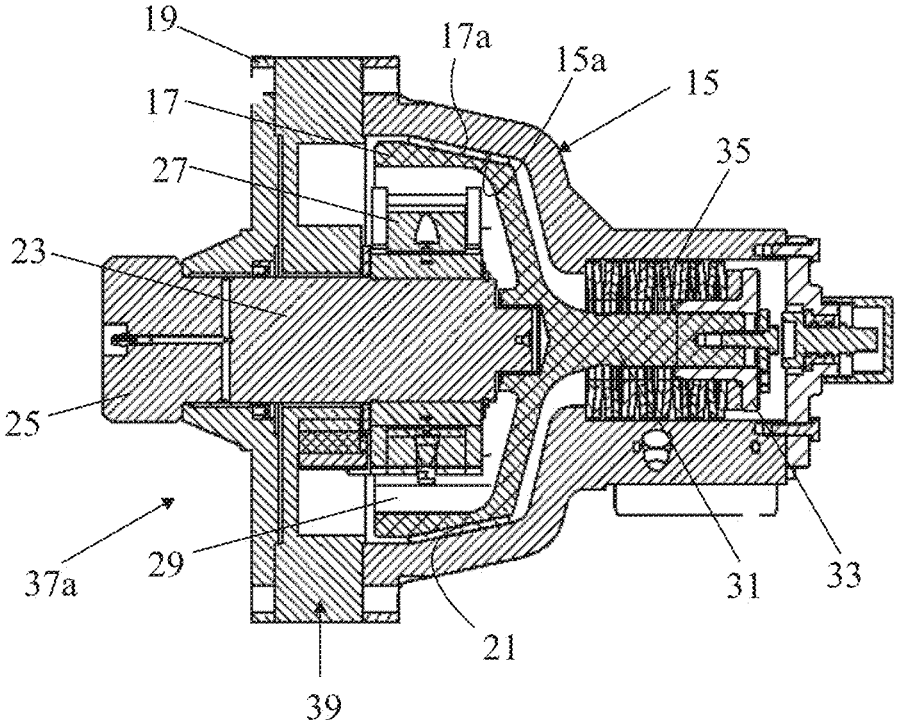
FIG. 4 shows a first embodiment of the catch of the elevator according to the invention in longitudinal section.

FIG. 4 shows a first embodiment of the catches according to the invention. This catch 37*a* has all parts of the known catch (these parts are designated by the same reference numerals as in the known catch) and furthermore has an annular housing part 39 between the cover 19 and the housing 15, within which the coupling means are located which, upon activation of a of the catch where the coupling catch 27 of this catch folds out, unfold the coupling catch of the other catch and thus activate this other catch.

Figure 5:
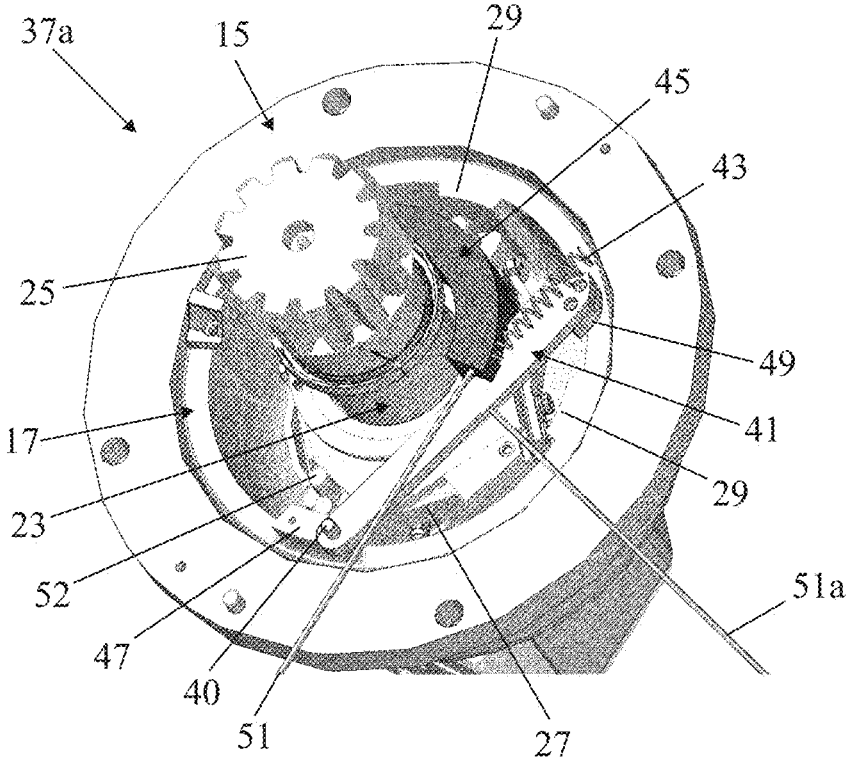
FIG. 5 shows the catch shown in FIG. 4 with the housing open in the inactive state.
Figure 6:
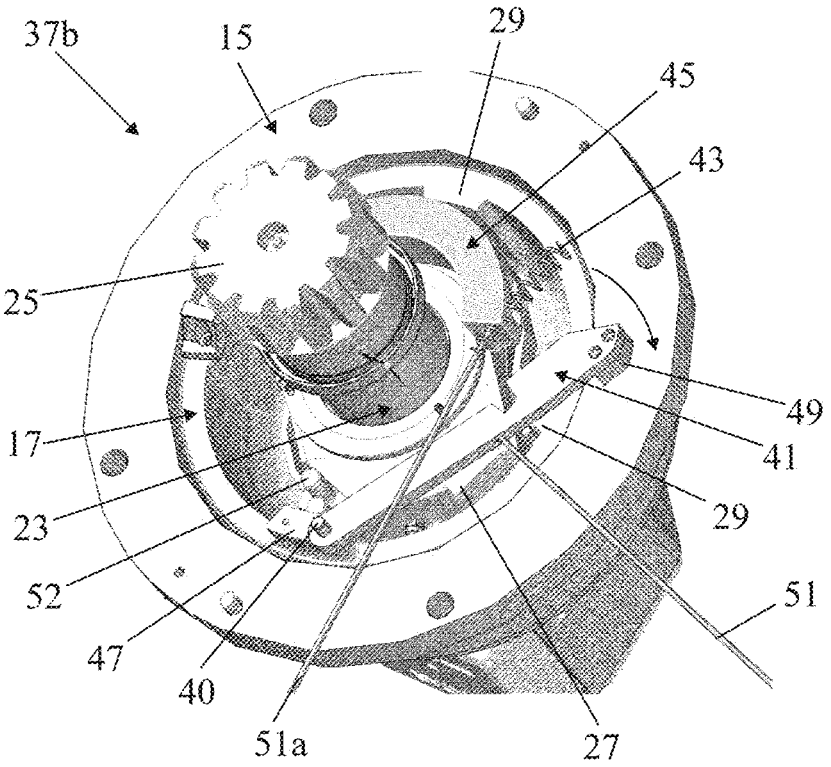
FIG. 6 shows the catch shown in FIG. 4 with the housing open during braking.

These coupling means are shown in the inactive position in FIG. 5 and have a release catch 41 which is rotatably connected to the housing 15 around a pin 40 and a comb 45 loaded by a spring 43 and also rotatably connected to the housing 15 around a pin (not visible in the figures). This comb is blocked against twisting by the release catch. When the brake drum 17 is rotated, the release catch 41 is rotated by an activation cam 47 present on the brake drum to the position shown in FIG. This activation cam 47 comes into contact with a release cam 49 provided on the release catch. Through this rotation the release catch 41 releases the comb 45 which is then rotated by the spring 43 and pulls on a coupling cable 51. This coupling cable is connected to the release catch 41 of the other catch 37*b*, see FIG. 6, and in so doing detaches it from the comb 45 of this other catch. This comb is rotated by the spring 43 to the active position shown in FIG. 6. In this active position the comb 45 is situated in the path of a carrier cam 52 present on the coupling pawl 27. When the shaft 23 is rotated further, this carrier cam 52 will be pressed outwards by the comb 45. The coupling pawl 27 fastened to the carrier cam will hereby be pivoted outwardly and hook behind one of the coupling lugs 29 and thereby couple the brake drum 17 with the shaft 23, so that this catch 37*b* is also switched on.

The trigger pawl 45 of the catch 37*b* is likewise connected by a further clutch cable 51*a* to the release pawl 41 of the catch 37*a* to engage this catch when the catch 37*b* first enters.

Figure 7:
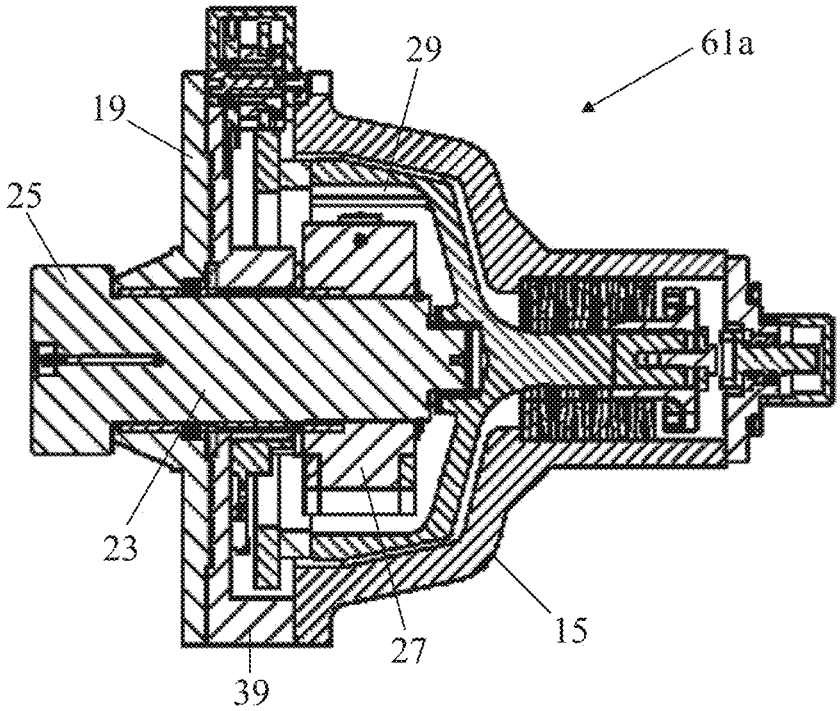
FIG. 7 shows a second embodiment of the catch of the elevator according to the invention in longitudinal section.

FIG. 7 shows a second embodiment of the catch according to the invention. All parts of this second embodiment which are identical to those of the first embodiment are designated by the same reference numerals. This catch 61*a* also has all parts of the known catch and also has an annular housing part 39 between the cover 19 and the housing 15, within which the coupling means are located.

Figure 8:
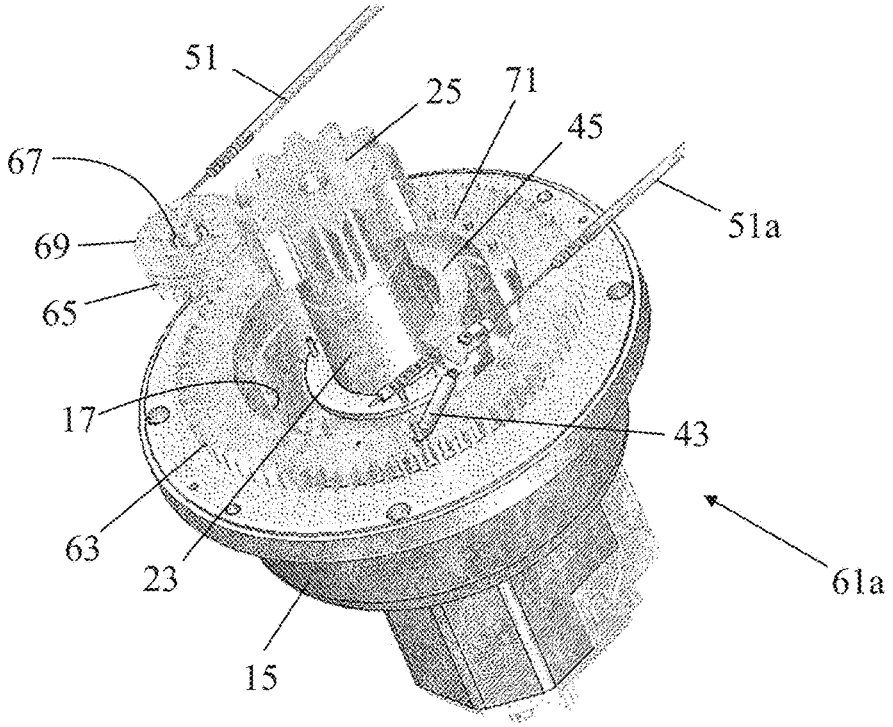
FIG. 8 shows the catch shown in FIG. 7 with the housing open with the comb in the inactive position.
Figure 9:
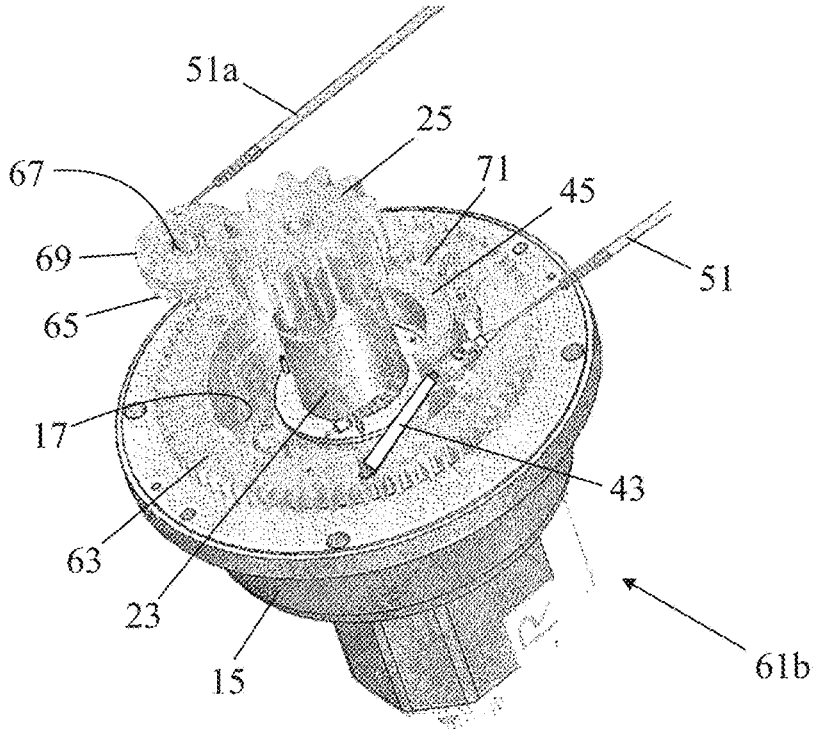
FIG. 9 shows the catch shown in FIG. 7 with the housing open with the comb in active position.

FIGS. 8 and 9 show the catches 61*a* and 61*b* of the second embodiment of the fall arrest device with the cam 45 in the inactive position (FIG. 8) and with the cam 45 in the active position (FIG. 9). Of this fall protection, each catch 61*a* and 61*b* has a main gear 63 connected to the brake drum 17, which rotates with the brake drum when the brake drum rotates, and a coupling gear 65 connected to the housing and engageable with the main gear. This coupling gear is connected via a slip coupling 67 to a cable pulley 69 to which a clutch cable 51 is attached. This coupling cable 51 is connected with the other end to the comb 45 of the other catch near the free end of this comb, see FIG. 9.

If one of the catches 61*a* is activated because the coupling catch catches behind the carrier cam and takes the brake drum 17 with it, the main gear 63 will rotate with the brake drum and thereby also rotate the coupling gear 65 with the cable pulley 69 connected thereto. The cable pulley will wind up the coupling cable 51 fastened to it, pulling the clutch cable. This clutch cable 51 will move the comb 45 of the other catch 61*b* against a spring force exerted by the spring 43 to the active position in the path of travel of the take-away cam on the coupling catch. This carrier cam comes into contact with the cam during rotation of the gear shaft and is thereby moved outwards in the radial direction together with the coupling catch, the coupling catch engaging behind the coupling cam on the brake drum of the other catch so that this brake drum 17 is coupled to the sprocket shaft 23. and this gear shaft and thus the elevator age will brake.

When the clutch cable 51 is tightened, the cam 45 of the catch 61*b* will be pulled against a stop 71. After this, the clutch cable 51 will come under a greater tension, as a result of which the slip coupling 67 will slip and the brake drum 17 can continue to rotate.

The cam 45 of the catch 61*a* is likewise connected by a further coupling cable 51*a* to the cable pulley 69 of the catch 61*b* to engage this catch when the catch 61*b* first comes into operation.

Although the present invention is elucidated above on the basis of the given drawings, it should be noted that this invention is not limited whatsoever to the embodiments shown in the drawings. The invention also extends to all embodiments deviating from the embodiments shown in the drawings within the context defined by the claims.

The invention claimed is:

1. Fall protection for an elevator, which elevator comprises a vertical guide, a gear rack extending in the vertical direction, an elevator cage movable along the guide, and lifting means for moving of the elevator cage along the guide, which fall protection comprises a catch which is attached to the elevator cage during use and which is activated when a downward speed of movement of the elevator cage exceeds a set maximum value, which catch comprises:

a housing attached to the elevator cage, a gear that is in engagement with the gear rack during use and is mounted on a gear shaft, a brake drum which is rotatably present in the housing and, during braking with a braking surface present on an outside, is frictionally in contact with an inner side of the housing, which brake drum is provided on the inside with a coupling cam, and a coupling pawl which is pivotable with an outer end about a pivot axis, which is parallel to and remote from the gear shaft and is connected to the gear shaft, and rotates through the centrifugal force of a folded position at high rotational speed of the gear shaft, in which the coupling pawl lies against the gear shaft, to a folded-out position, wherein the coupling pawl is moved outwards with the other end and presses against the coupling cam and thereby couples the gear shaft to the brake drum, wherein the fall protection alongside said catch further comprises a further catch which is identical to said catch, and in that the fall protection comprises coupling means connecting the two catches with each other such that when moving the coupling pawl from one of the catches to the folded-out position, move the coupling pawl from the other catch to the folded-out position, which coupling means are located in the axial direction next to the brake drum in the housing.

2. Fall protection device according to claim 1, wherein a carrier cam is present on the coupling pawl and each catch comprises a comb which fits in the housing and is rotatable about a further pivot axis which is also parallel to the gear shaft and is connected to the housing and is rotatable between an active position, in which the comb is present in the path of movement of the carrier cam and guiding the carrier cam outwards, wherein the coupling pawl is moved to the folded-out position, and an inactive position, in which the comb is removed from the path of the carrier cam, and the coupling means are such that they are displaced move the comb from the other catch to the active position from the coupling pawl from the catch to the folded-out position so that this comb moves the coupling pawl from the other catch to the folded-out position.

3. Fall arrest device according to claim 2 wherein the coupling means comprise two coupling cables each of which are attached to one of the combs with one end and are connected to a release catch with the other end.

4. Fall protection device according to claim 2 wherein each catch comprises a release catch connected to the housing, which release catch blocks the comb which is connected to a spring and which release catch, when the brake drum is rotated, is rotated by a release cam present on the brake drum, thereby releasing the comb which is then displaced by the spring, one of the coupling cables-having one end is connected to the comb of the catch and the other end is connected to the release catch of the other catch and that on rotation of the comb of this catch the release catch of the other catch is displaced whereby also the comb of this other catch is rotated into the rotational path of a take-up cam present on the coupling catch which rotates during rotation of the shaft comes into contact with the comb and is moved together with the coupling catch to a position in which the coupling catch behind the coupling cam on the brake drum.

5. Fall protection device according to claim 1 wherein each catch comprises:

a comb, a main gear connected to the brake drum, which rotates with the brake drum when the brake drum rotates, a coupling gear connected to the housing which is in engagement with the main gear and is connected via a slip coupling to a cable pulley to which one of the coupling cables is fixed, which coupling cable to the another end is connected to the comb of the other catch near the free end of this comb.

6. An elevator comprising a vertical guide, an elevator cage displaceable along the guide, lifting means for displacing the elevator cage along the guide, and a fall protection device according to claim 1 fixed to the elevator cage.

* * * * *